US006756742B2

(12) United States Patent
Tsai et al.

(10) Patent No.: US 6,756,742 B2
(45) Date of Patent: Jun. 29, 2004

(54) DRIVING DEVICE AND METHOD FOR A FLAT PANEL DISPLAY

(75) Inventors: Chung-Kuang Tsai, Hsinchu (TW); Li-Ru Lyu, Jubei (TW)

(73) Assignee: Au Optronics Corp., Hsinchu (TW)

( * ) Notice: Subject to any disclaimer, the term of this patent is extended or adjusted under 35 U.S.C. 154(b) by 0 days.

(21) Appl. No.: 10/439,732

(22) Filed: May 16, 2003

(65) Prior Publication Data

US 2003/0222592 A1 Dec. 4, 2003

(30) Foreign Application Priority Data

May 29, 2002 (TW) ..... 91111473 A

(51) Int. Cl.[7] ..... G09G 3/10

(52) U.S. Cl. ..... 315/169.3; 315/169.4; 345/76; 345/79

(58) Field of Search ..... 315/169.3, 169.4, 315/169.1; 345/76, 78, 79

(56) References Cited

U.S. PATENT DOCUMENTS 5,446,344 A * 8/1995 Kanazawa ..... 315/169.4
6,483,251 B2 * 11/2002 Setoguchi et al. ..... 315/169.4

* cited by examiner

*Primary Examiner*—David Vu
(74) *Attorney, Agent, or Firm*—Ladas & Parry

(57) ABSTRACT

A driving method for a flat panel display. First, an image signal is transformed to frame data. Next, characteristic data for the frame data is obtained. Next, a scanning order of the first electrodes is determining according to the characteristic data. Next, scanning electrodes are driven in the scanning order during the addressing period. Finally, the data electrodes corresponding to the first electrodes are driven to perform the addressing operation.

19 Claims, 9 Drawing Sheets

DRIVING DEVICE AND METHOD FOR A FLAT PANEL DISPLAY

BACKGROUND OF THE INVENTION

1. Field of the Invention

The present invention relates in general to a driving device and a driving method for a flat panel display. In particular, the present invention relates to a driving device and a driving method to decrease the switching frequency of a data chip, which provides the addressing voltage of the data electrodes of a flat panel display, by changing the scanning order of the scanning electrodes.

2. Description of the Related Art

Flat panel display comprises liquid crystal display (LCD), organic light-emitting display (OLED), and plasma display panel (PDP), etc. The advantages of the plasma display panel are small size, good display performance, and high reliability. Thus, PDP is often used in current electric equipment.

The current method of driving a plasma display panel is achieved through a plurality of subfield-display operations, which altogether constitute a full frame-display operation. For example, a picture frame in a plasma display panel with 256 gray levels may comprise eight subfields SF0~SF7 as shown in FIG. 1A. Each subfield-display operation comprises steps of resetting, addressing, and sustaining the display signal. Specifically, a plasma display panel is driven by a driving signal which comprises an erasing period, a addressing period, and a sustaining period. During the erasing period, residual ions of each illuminant cell of a PDP are erased using a voltage pulse having a pulse width shorter than a sustaining pulse. During the addressing period, external data are input using a voltage pulse having a voltage higher than a sustaining pulse of the erasing period. During the sustaining period, an AC voltage of a constant frequency is applied to avoid an ignition miss or incorrect display and to obtain a correct power margin.

FIG. 1B shows a cross section of a conventional PDP structure, and FIG. 1C shows a schematic top view of the data and scanning electrodes of the same PDP. As shown in FIG. 1B, a PDP is constructed by joining a front glass substrate 1 with a rear glass substrate 2, wherein data electrodes 3 for inputting external data are formed on the surface of the front glass substrate 1 that opposes the rear glass substrate 1. Furthermore, a plurality of ribs 4 is defined on the data electrodes 3 to form illuminant cells. A plurality of sustaining electrodes 7 and scanning electrodes 8 in parallel direction, on the other hand, are formed on the surface of the rear glass substrate 2 that opposes the front glass substrate 1, wherein the above-mentioned data electrodes 3 are formed perpendicular to both the sustaining electrodes 7 and the scanning electrodes 8.

In addition, the surfaces of both the sustaining electrodes 7 and scanning electrodes 8 are coated with a dielectric layer 6 (such as a MgO layer) for protecting the surfaces of the electrodes. Furthermore, a fluorescent material 5 (such as phosphorous) is deposited between ribs (where the illuminant cells reside) for illumination to occur as soon as a voltage is applied. As shown in FIGS. 1C and 1D, a typical conventional plasma display panel comprises a plurality of row plasma display units (represented by $L_1$~$L_N$). Each row display unit has one of the plurality sustaining electrodes 7 (represented by a corresponding $X_1$~$X_N$), one of the plurality of parallel scanning electrodes 8 ($Y_1$~$Y_N$); for example, the first row display unit $L_1$ comprises the first sustaining electrode $X_1$, and the first scanning electrode $Y_1$. The plurality of illuminant cells of the first row display unit $L_1$ is driven by the $X_1$, $Y_1$ simultaneously during the sustaining period. The plurality of data electrodes 3 ($A_1$~$A_M$) are disposed perpendicular to both the sustaining electrodes 7 ($X_1$~$X_N$) and the scanning electrodes 8 ($Y_1$~$Y_N$). Each of the sustaining electrodes 7 ($X_1$~$X_N$) is connected to the others and thereby the electrodes can be driven synchronously. In contrast, each of the scanning electrodes 8 ($Y_1$~$Y_N$) is separately connected from the other electrodes so as to actuate each of the electrodes independently. Thus, external data are input to each illuminant cell of the plasma display panel via the data electrodes 3 ($D_1$~$D_M$) by controlling both the sustaining electrodes 7 (X1~XN) and the scanning electrodes 8 ($Y_1$~$Y_N$).

FIG. 2 is a driving signal diagram of various electrodes of the plasma display panel shown in FIGS. 1B, 1C, and ID, which are driven according to the method of a prior art. Accordingly, a plasma display panel is driven by a driving signal comprising an erasing period, an addressing period, and a sustaining period. During the erasing period, a very short pulse VW of a high voltage is applied to all of the sustaining electrodes 7 (including $X_1$~$X_N$), and all of the scanning electrodes 8 (including $Y_1$~$Y_N$) are connected to the ground Vg, so as to remove the remaining residual ions. At this point, no data electrodes 3 (including $D_1$~$D_M$) are yet driven. During the addressing period, a bias $V_K$ is applied to all of the sustaining electrodes 7 (including $X_1$~$X_N$), so the scanning electrodes 8 ($Y_1$~$Y_N$) can input external data sequentially via the data electrodes 3 ($D_1$~$D_M$) based on an addressing signal VY. At this point, the scanning electrodes 8 ($Y_1$~$Y_N$) are connected to a row address decoder (not shown in the figure) to receive an addressing signal, and the data electrodes 3 ($D_1$~$D_M$) are connected to external data to precede write operations. During the sustaining period, a periodic voltage pulse Vs is alternately applied to the sustaining electrodes 7 ($X_1$~$X_N$) and the scanning electrodes 8 (including $Y_1$~$Y_N$) to maintain the luminance of the illuminant cells.

During the addressing period, conventional method enables the scanning electrodes according to the subfield data in a fixed order, and the data chip provides the addressing voltage to the data electrodes corresponding to the driven scanning electrodes. However, the number of the switching cell of the data chip is directly proportional to the used power, because there is a parasitical capacitor Cd between the electrodes. When the voltage between the electrodes is raised to $V_{dd}$, the consumed power is $(½)C_dV_{dd}^2$. Moreover, when the voltage between the electrodes returns to a low level, the consumed power is $(½)C_dV_{dd}^2$ again. The consumed power increases the temperature of the data chip, especially when the subfield data is interleaved scanning, and the temperature may reaches 100° C., which wastes power and decreases the life of the data chip.

SUMMARY OF THE INVENTION

The object of the present invention is to provide a driving device and a driving method for a flat panel display, which analyzes the characteristic of the subfield before addressing, and addresses the electrodes in a suitable order to decrease the voltage switching frequency of the data chip.

Moreover, another object of the present invention is to provide a driving device and a driving method for a flat panel display, which detects the output current of the power supply to the flat panel display. When the output current exceeds a predetermined value, the scanning order of the flat panel display is changed to decrease the output current, such that the voltage switching frequency of the data chip is decreased.

To achieve the above-mentioned object, the present invention provides a driving method for a flat panel display. First, an image signal is transformed to frame data. Next, a characteristic data of the frame data is obtained. Next, a scanning order of the first electrodes is determined according to the characteristic data. Next, scanning electrodes are driven in the scanning order during the addressing period. Finally, the data electrodes corresponding to the first electrodes are driven to perform the addressing operation.

Moreover, the present invention provides a driving method for a flat panel display comprising a power supply, first electrodes, and second electrodes corresponding to the first electrodes. The driving method comprises the steps of driving the first electrodes and corresponding second electrodes in a first scanning order during the addressing period to perform the addressing operation, detecting the current output from the power supply, and driving the first electrodes and corresponding second electrodes in a second scanning order different from the first scanning order when the current output from the power supply is larger than a predetermined value for a predetermined time.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

According to the present invention, the controlling circuit controls the driving order of the scanning electrode driving circuit addressing the scanning electrodes. Thus, the numbers of the voltage switching is decreased when the corresponding data electrodes are driven.

First Embodiment

Figure 1A:
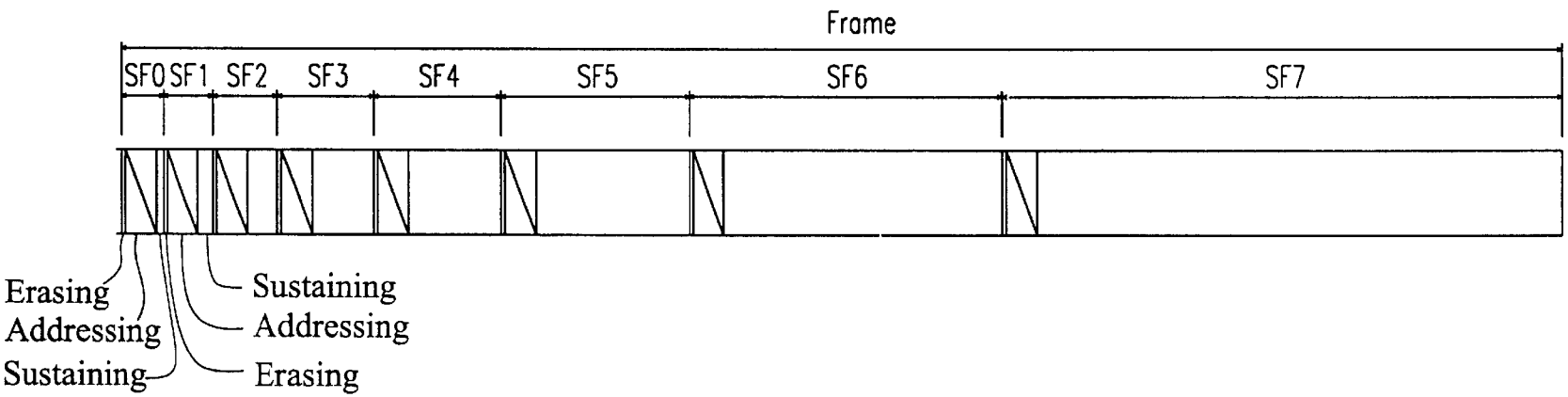
FIG. 1A (PRIOR ART)
FIG. 1A shows the subfields included in a picture frame in a plasma display panel with 256 gray levels.
Figure 1B:
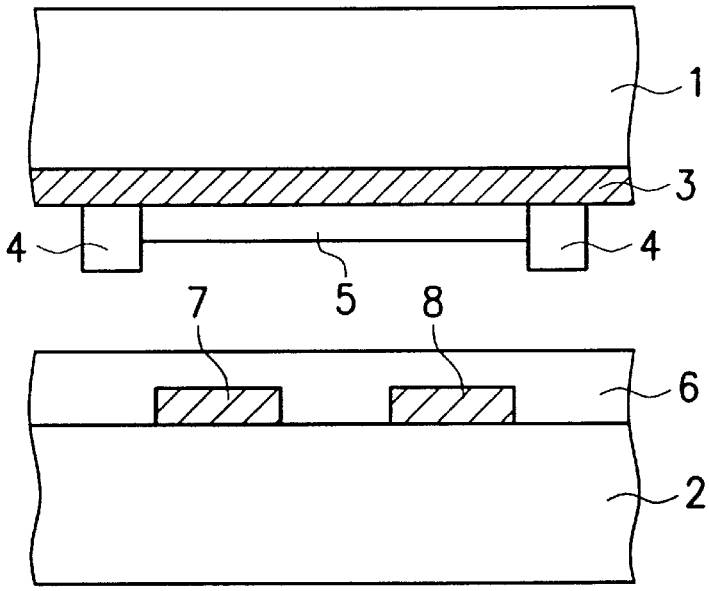
FIG. 1B (PRIOR ART)
FIG. 1B shows a cross section of a conventional PDP structure.
Figure 1C:
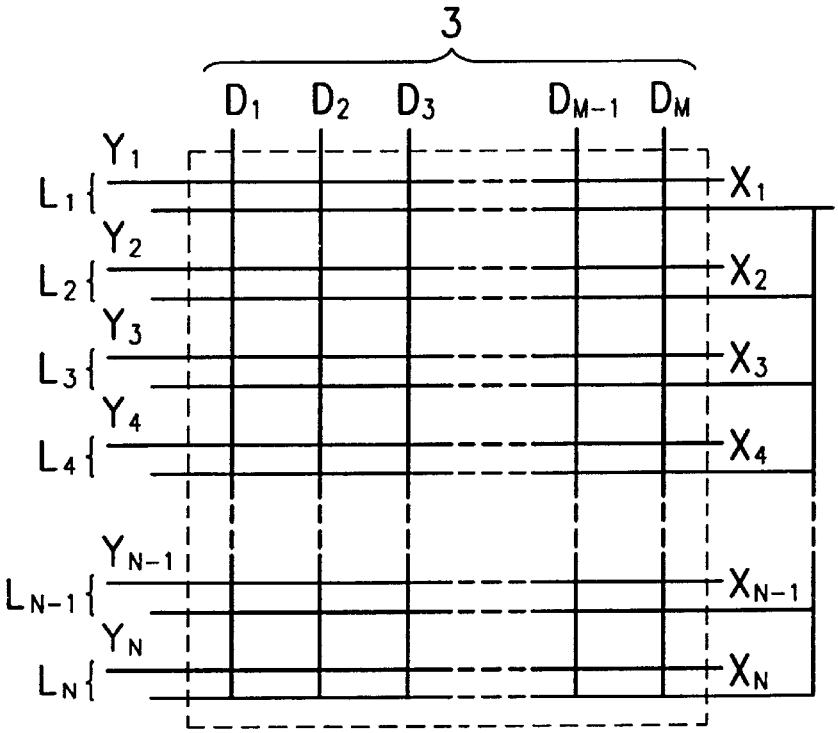
FIG. 1C (PRIOR ART)
FIGS. 1C and 1D shows a schematic top view of the data and scanning electrodes of the same PDP.
Figure 1D:
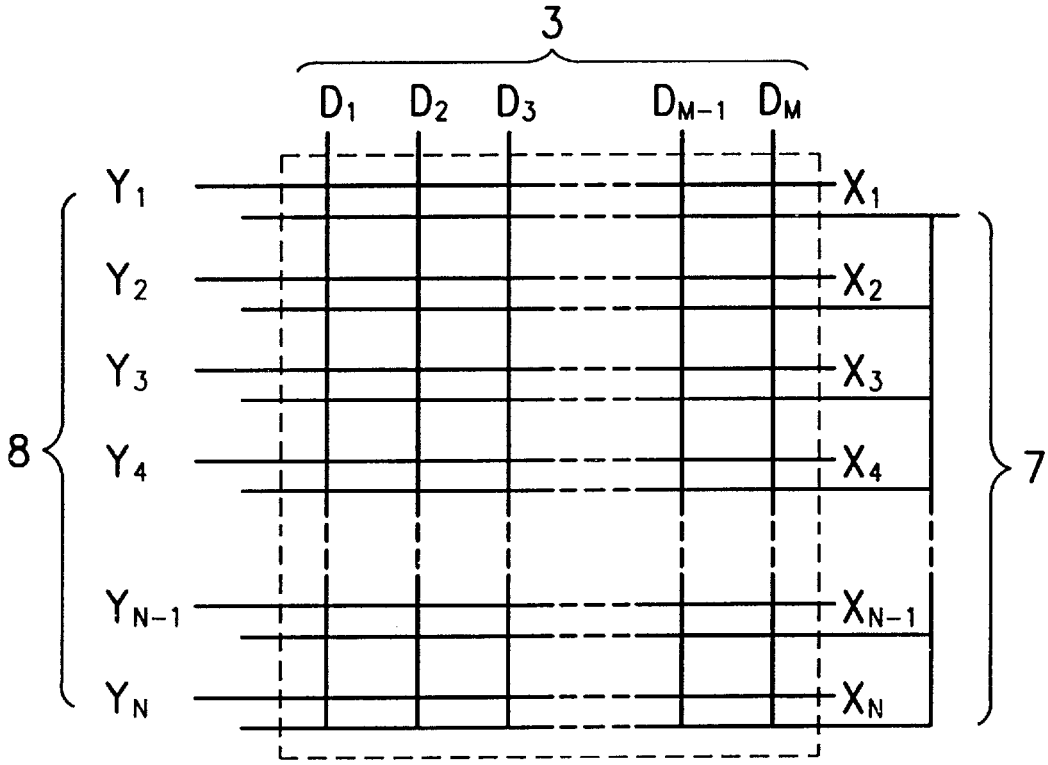
FIG. 1D (PRIOR ART)
Figure 2:
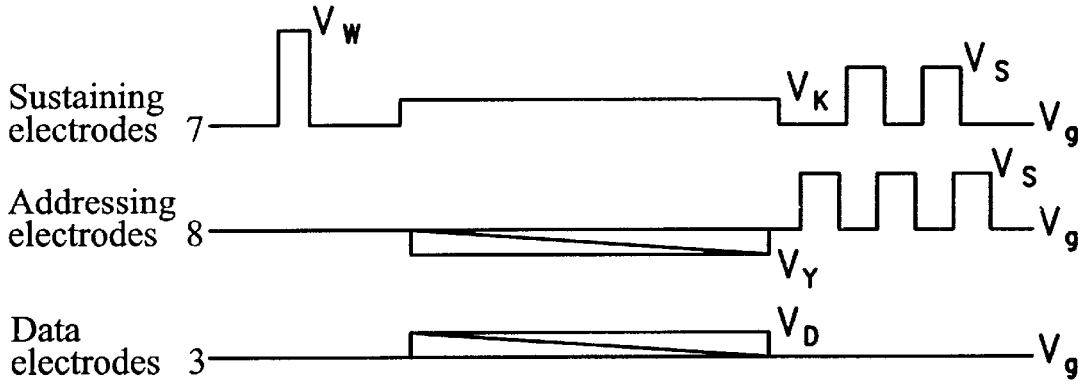
FIG. 2 is a driving signal diagram of various electrodes of the conventional plasma display panel.
Figure 3:
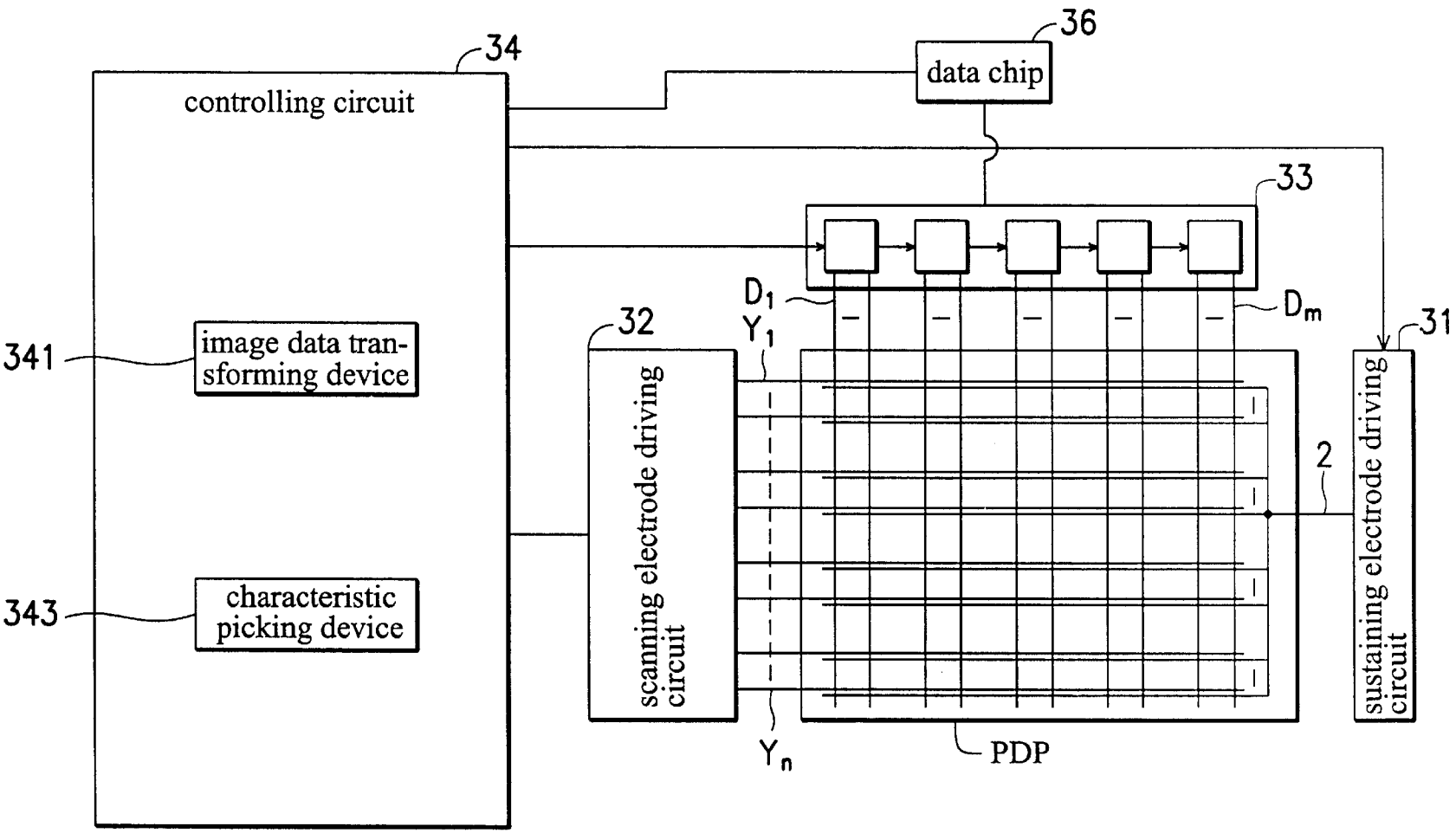
FIG. 3 shows the block diagram of the PDP and driving circuits according to the first embodiment of the present invention.

FIG. 3 shows the block diagram of the PDP and driving circuits according to the first embodiment of the present invention. The present embodiment dynamic selects the driving order according to the characteristic of the displayed frame. The scanning electrode driving circuit 32 provides scanning and sustain discharge pulses to the scanning electrodes $Y_1$~$Y_n$, the sustaining electrode driving circuit 31 provides sustain discharge pulses to the sustaining electrodes 7, and the data electrode driving circuit 33 provides data pulses to the data electrodes $D_1$~$D_m$. The controlling circuit 34 controls the operation of the sustaining electrode driving circuit 31, the scanning electrode driving circuit 32 and the data electrode driving circuit 33.

The controlling circuit 34 comprises an image data transforming device 341 and a characteristic selection device 343. The image data transforming device 341 transforms the image data to a subfield data, and the characteristic selection device 343 analyzes the subfield data and obtains the characteristic information of the subfield data. The characteristic information of the subfield data is obtained by characteristic selection method or mask technology. The characteristic information records the intervals between the lighting cells in each frame. Thus, the controlling circuit 34 outputs a scanning order controlling signal representing a specific order to enable the scanning electrodes $Y_1$~$Y_n$ according to the analyzing result of the characteristic selection device 343. Therefore, the scanning electrodes having the same voltage level are enabled in turn. When the scanning electrodes having the same voltage level are all enabled, then the scanning electrodes having other voltage levels are enabled.

The scanning electrode driving circuit 32 drives the scanning electrodes $Y_1$~$Y_n$ in the corresponding order according to the scanning order controlling signal. For example, the scanning electrode driving circuit 32 drives the scanning electrodes of the lighting display cells first, then drives the scanning electrodes of the unlighted display cells later.

The data electrode driving circuit 33 drives the data electrodes $D_1$~$D_m$ when corresponding scanning electrodes are driven. The driving voltage of each data electrode is provided by a data chip 36. Because the driving order of the data electrode follows the driving order of the scanning electrode, the driving voltage of the data electrodes is the same when the corresponding scanning electrodes having the same driving voltage are driven. Therefore, the data chip provides one voltage level to the data electrodes having the same driving voltage first, then switches the output voltage level to provide another voltage level to the other data electrodes. Thus, the voltage switching times of the data chip are decreased, and the consumption of power is also decreased.

Second Embodiment

Figure 4:
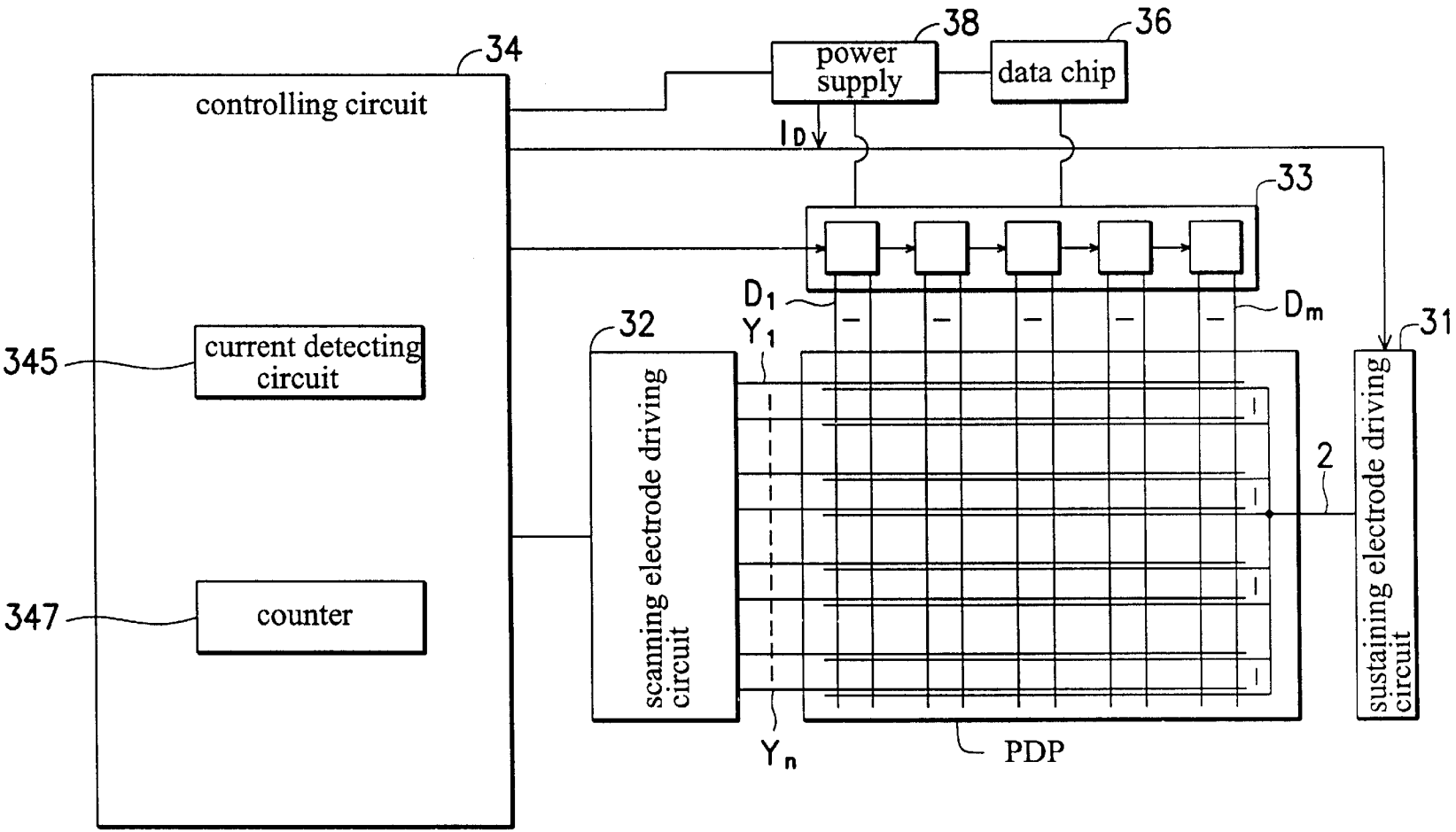
FIG. 4 shows the block diagram of the PDP and driving circuits according to the second embodiment of the present invention.

FIG. 4 shows the block diagram of the PDP and driving circuits according to the second embodiment of the present invention. The present embodiment determines the scanning order to be changed by detecting the power consumption of the PDP during the addressing period, and provides a suitable scanning order according to the detected result.

The scanning electrode driving circuit 32 provides scanning and sustain discharge pulses to the scanning electrodes $Y_1$~$Y_n$, the sustaining electrode driving circuit 31 provides sustain discharge pulses to the sustaining electrodes 7, and the data electrode driving circuit 33 provides data pulses to the data electrodes $D_1$~$D_m$. The controlling circuit 34 controls the operation of the sustaining electrode driving circuit 31, the scanning electrode driving circuit 32 and the data electrode driving circuit 33.

The power supply 38 provides power to the PDP. During the addressing period, the controlling circuit 34 outputs a scanning order controlling signal representing a first scanning order during addressing, and detects the output current $I_d$ of the power supply 38. The controlling circuit 34 outputs another scanning order controlling signal representing a second scanning order different from the first scanning order when the output current $I_d$ exceeds a predetermined value.

In the present embodiment, three scanning orders are selected by the controlling circuit 34 to drive the scanning electrodes, namely sequential scanning, interleave scanning and interleave jump four scanning. Assuming there are sixteen scanning electrodes, the scanned order of the electrodes is [1, 2, 3, 4, . . . , 15, 16] when sequential scanning is performed, the scanned order of the electrodes is [1, 3, 5, 7, . . . , 2, 4, 6, 8, . . . ] when interleave scanning is performed, and the scanned order of the electrodes is [1, 5, 9, 13, . . . , 4, 8, 12, 16, . . . ] when interleave jump four scanning is performed. The scanning order controlling signal indicates a specific scanning order as described above.

Figure 5:
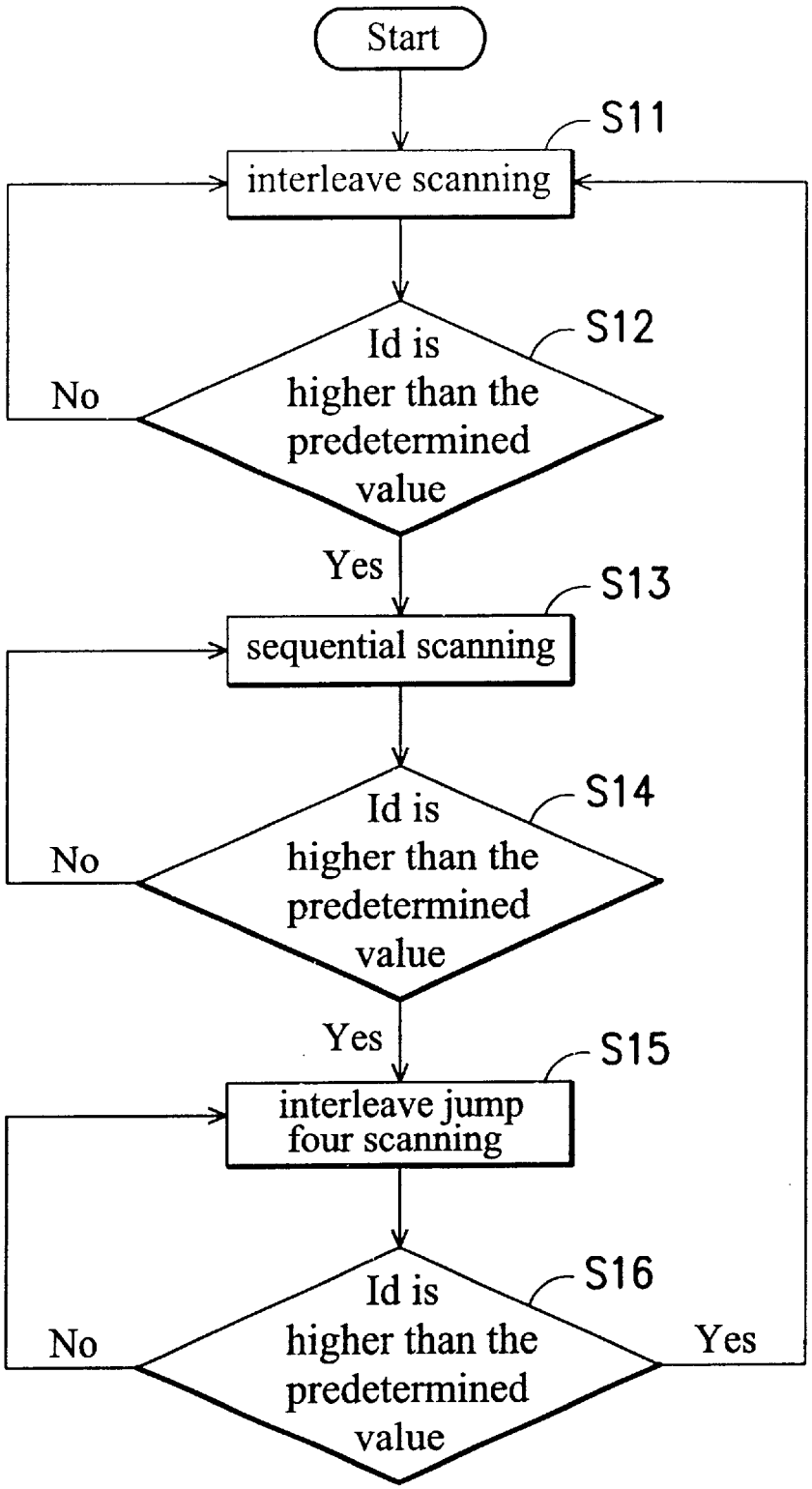
FIG. 5 shows a flowchart of the decision of the scanning order according to the second embodiment of the present invention.

FIG. 5 shows a flowchart of the decision of the scanning order according to the second embodiment of the present invention. During the addressing period, the current detecting circuit 345 of the controlling circuit 34 detects the output current $I_d$ of the power supply 38. For example, the interleave scanning is performed first (S11), then the current detecting circuit 345 detects the output current $I_d$ (S12). When the output current $I_d$ is lower than the predetermined value, the performed scanning order is suitable for the present displayed frame, so the present scanning order continues (back to step S11). When the output current $I_d$ is higher than the predetermined value, the scanning order is changed to sequential scanning (S13). Similarly, the current detecting circuit 345 detects the output current Id (S14). When the output current $I_d$ is lower than the predetermined value, the present scanning order continues (back to step S13). When the output current $I_d$ is higher than the predetermined value, the scanning order is changed to interleave jump four scanning (S15). Similarly, the current detecting circuit 345 detects the output current $I_d$ (S16). When the output current $I_d$ is lower than the predetermined value, the present scanning order continues (back to step S15). When the output current $I_d$ is higher than the predetermined value, the scanning order is changed to interleave scanning (S11). Therefore, the performed scanning order used in the present frame decreases the voltage switching frequency of the data chip.

When the scanning order is determined, the scanning electrode driving circuit 32 drives the scanning electrodes $Y_1$~$Y_n$ in the scanning order according to the scanning order controlling signal.

The data electrode driving circuit 33 drives the data electrodes $D_1$~$D_m$ when corresponding scanning electrodes are driven. A data chip 36 provides the driving voltage of each data electrode.

Figure 6A:
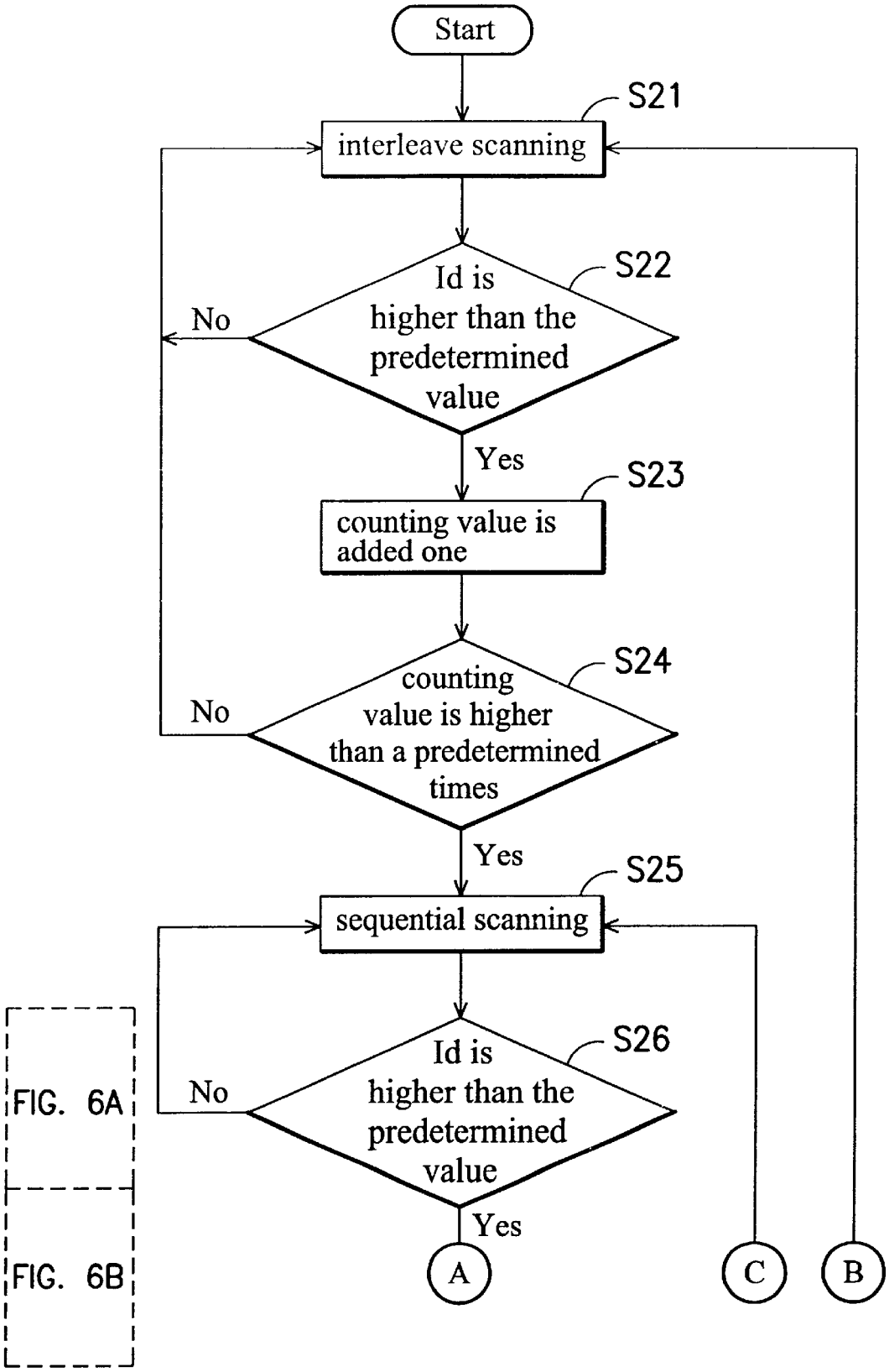
FIGS. 6A and 6B show another flowchart of the decision of the scanning order according to the second embodiment of the present invention.
Figure 6B:
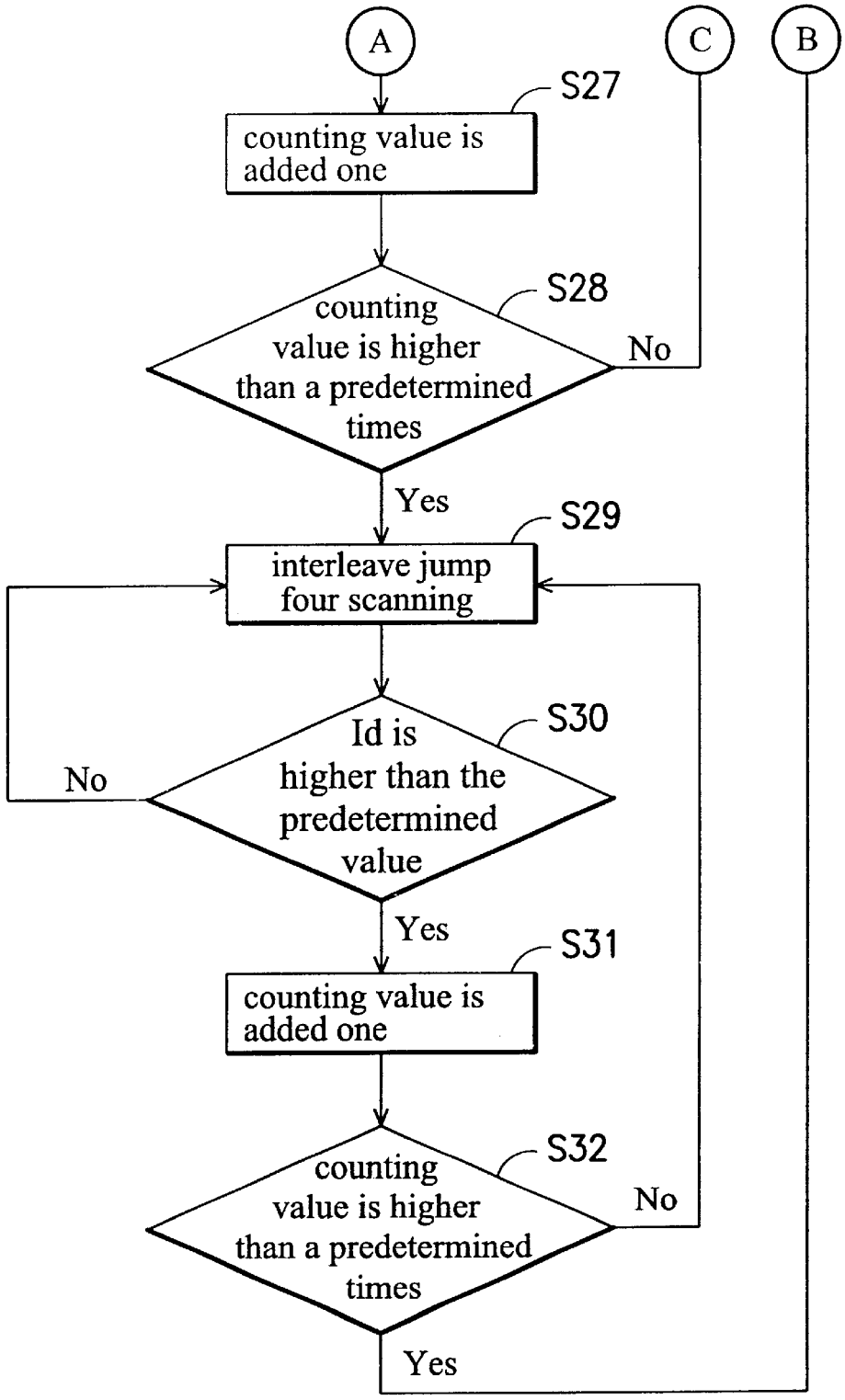

To prevent errors in detecting the output current $I_d$, a verification step is added to another example of the present embodiment. FIGS. 6A and 6B show flowcharts of the decision of the scanning order according to the example of the second embodiment, wherein a verification step is added.

During the addressing period, the current detecting circuit 345 of the controlling circuit 34 detects the output current $I_d$ of the power supply 38. For example, interleave scanning is performed first (S21), then the current detecting circuit 345 detects the output current $I_d$ (S22). When the output current $I_d$ is lower than the predetermined value, the performed scan is suitable for the present displayed frame, so the present scanning order continues (back to step S21). When the current detecting circuit 345 detects output current $I_d$ higher than the predetermined value, the counting value of the counter 347 is increased by one (S23). Next, the counting value is detected by the controlling circuit (S24). If the counting value reaches a predetermined number, the scanning order is changed to sequential scanning (S25), and the counting value is reset. If not, the process goes back to step S21. Here, the predetermined number is designated by the user.

After step S25, the current detecting circuit 345 detects the output current $I_d$ (S26). When the output current $I_d$ is lower than the predetermined value, the present scanning order continues (back to step S25). When the output current $I_d$ is higher than the predetermined value, the counting value of the counter 347 is added (S27). Next, the counting value is detected by the controlling circuit (S28). If the counting value reaches the predetermined number, the scanning order is changed to interleave jump four scanning (S29), and the counting value is reset. If not, the process goes back to step S25.

After step S29, the current detecting circuit 345 detects the output current $I_d$ (S30). When the output current $I_d$ is lower than the predetermined value, the present scanning order continues (back to step S29). When the output current $I_d$ is higher than the predetermined value, the counting value of the counter 347 is added (S31). Next, the counting value is detected by the controlling circuit (S32). If the counting value reaches the predetermined number, the scanning order is changed to interleave scanning (S21), and the counting value is reset. If not, the process goes back to step S29.

Therefore, the scanning order is determined by detecting the output current of the power supply. In addition, the process disclosed in FIGS. 6A and 6B prevents the determination of the selected scanning order from being influenced by the noise. Thus, the voltage switching times of the data chip is decreased, and the consumption of the power is also decreased.

Accordingly, the scanning order of the scanning electrodes is adjusted to decrease the voltage switching frequency of the data chip. Therefore, the power consumption is also decreased. In addition, the life of the chip is increased, and the reliability of the circuit is increased because the decreasing voltage switching decreases electromagnetic interfering.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A driving method for a flat panel display comprising first electrodes and second electrodes corresponding to the first electrodes, the driving method comprising the following steps:

transforming an image signal to frame data;

obtaining characteristic data of the frame data;

determining a scanning order of the first electrodes according to the characteristic data;

driving the first electrodes in the scanning order during the addressing period; and driving the second electrodes corresponding to the first electrodes to perform the addressing operation.

2. The driving method as claimed in claim 1, wherein the frame data is a subfield data.

3. The driving method as claimed in claim 1, wherein the flat panel display is a plasma display panel.

4. A driving method for a flat panel display comprising a power supply, first electrodes and second electrodes corresponding to the first electrodes, the driving method comprising the following steps:

driving the first electrodes and corresponding second electrodes in a first scanning order during the addressing period to perform the addressing operation;

detecting the current output from the power supply; and driving the first electrodes and corresponding second electrodes in a second scanning order different from the first scanning order when the current output from the power supply is larger than a predetermined value during the addressing period to perform the addressing operation.

5. The driving method as claimed in claim 4, wherein the flat panel display is a plasma display panel.

6. A driving method for a flat panel display comprising a power supply, first electrodes and second electrodes corresponding to the first electrodes, the driving method comprising the following steps:

driving the first electrodes and corresponding second electrodes in a first scanning order during the addressing period to perform the addressing operation;

detecting the current output from the power supply; and driving the first electrodes and corresponding second electrodes in a second scanning order different from the first scanning order when the current output from the power supply is larger than a predetermined value for a predetermined time.

7. The driving method as claimed in claim 6, wherein the flat panel display is a plasma display panel.

8. A driving device of a flat panel display comprising first electrodes and second electrodes corresponding to the first electrodes, comprising:

a controlling circuit for transforming an image signal to frame data having characteristic information and determining a scanning order of the first electrodes according to the characteristic information, then outputting a scanning order controlling signal corresponding to the scanning order in addressing period;

a first electrode driving circuit for driving the first electrodes according to the scanning order controlling signal in the scanning order; and a second electrode driving circuit for driving the second electrodes when the corresponding first electrodes are driven.

9. The driving device of a flat panel display as claimed in claim 8, wherein the frame data is subfield data.

10. The driving device of a flat panel display as claimed in claim 8, wherein the controlling circuit comprises:

an image data transforming device for transforming the image data to frame data;

a characteristic selection device for obtaining characteristic information of the frame data.

11. The driving device of a flat panel display as claimed in claim 8, further comprising a data chip for providing driving voltages to the second electrodes.

12. The driving device of a flat panel display as claimed in claim 8, wherein the flat panel display is a plasma display panel.

13. A driving device of a flat panel display comprising first electrodes and second electrodes corresponding to the first electrodes, comprising:

a power supply for providing driving current to the flat panel display;

a controlling circuit for detecting the driving current output from the power supply and providing a scanning order controlling signal during the addressing period, wherein the scanning order controlling signal represents a first scanning order when the driving current is smaller than a predetermined value and represents a second scanning order different from the first scanning order when the driving current is larger than the predetermined value;

a first electrode driving circuit for driving the first electrodes according to the scanning order controlling signal; and a second electrode driving circuit for driving the second electrodes when the first electrodes are driven.

14. The driving device of a flat panel display as claimed in claim 13, further comprising a data chip for providing driving voltages to the second electrodes.

15. The driving device of a flat panel display as claimed in claim 13, wherein the flat panel display is a plasma display panel.

16. A driving device of a flat panel display comprising first electrodes and second electrodes corresponding to the first electrodes, comprising:

a power supply for providing driving current of the flat panel display;

a controlling circuit for detecting the driving current output from the power supply and providing a scanning order controlling signal during the addressing period, wherein the scanning order controlling signal represents a first scanning order when the driving current is smaller than a predetermined value and represents a second scanning order different from the first scanning order when the driving current is larger than the predetermined value for a predetermined time;

a first electrode driving circuit for driving the first electrodes according to the scanning order controlling signal; and a second electrode driving circuit for driving the second electrodes when the first electrodes are driven.

17. The driving device of a flat panel display as claimed in claim 16, further comprising a data chip for providing driving voltages to the second electrodes.

18. The driving device of a flat panel display as claimed in claim 16, wherein the controlling circuit further comprises a counter for obtaining the times of the driving current exceeding the predetermined value.

19. The driving device of a flat panel display as claimed in claim 16, wherein the flat panel display is a plasma display panel.

* * * * *